US010837392B2

(12) United States Patent
Inaba et al.

(10) Patent No.: US 10,837,392 B2
(45) Date of Patent: Nov. 17, 2020

(54) INJECTION CONTROL DEVICE

(71) Applicant: DENSO CORPORATION, Kariya (JP)

(72) Inventors: Masashi Inaba, Kariya (JP); Noboru Nagase, Kariya (JP); Taichi Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/382,388

(22) Filed: Apr. 12, 2019

(65) Prior Publication Data

US 2019/0323447 A1 Oct. 24, 2019

(30) Foreign Application Priority Data

Apr. 20, 2018 (JP) ..... 2018-081374

(51) Int. Cl.

| | |
|---|---|
| ***F02D 41/36*** | (2006.01) |
| ***F02M 21/02*** | (2006.01) |
| ***F02D 41/20*** | (2006.01) |
| ***F02D 41/24*** | (2006.01) |
| *F02D 41/28* | (2006.01) |

(52) U.S. Cl.

CPC ..... *F02D 41/365* (2013.01); *F02D 41/20* (2013.01); *F02D 41/24* (2013.01); *F02M 21/0242* (2013.01); *F02D 2041/2013* (2013.01); *F02D 2041/2024* (2013.01); *F02D 2041/2075* (2013.01); *F02D 2041/281* (2013.01)

(58) Field of Classification Search

CPC ..... F02D 41/365; F02D 41/20; F02D 41/24; F02D 2041/281; F02D 2041/2075; F02D 2041/2013; F02D 2041/2024; F02D 2041/2003; F02M 21/0242

See application file for complete search history.

(56) References Cited

U.S. PATENT DOCUMENTS

| | | | | |
|---|---|---|---|---|
| 4,733,326 | A * | 3/1988 | Harsch | H03K 17/08146 361/159 |
| 7,474,035 | B2 * | 1/2009 | Fukagawa | F02D 41/2096 123/490 |
| 9,957,933 | B2 * | 5/2018 | Harada | F02D 41/20 |
| 2006/0103237 | A1 * | 5/2006 | Uemura | F02D 41/20 307/1 |

(Continued)

FOREIGN PATENT DOCUMENTS

JP 2016-160920 A 9/2016

*Primary Examiner* — Xiao En Mo

(74) *Attorney, Agent, or Firm* — Posz Law Group, PLC

(57) ABSTRACT

An injection control device controls a solenoid in a fuel injection valve. The injection control device includes a transistor on an upstream side of a first power supply path to the solenoid and a transistor on an upstream side of a second power supply path to the solenoid. The injection control device has another transistor with a body diode arranged in parallel at a position on the first power supply path between the first transistor and an upstream terminal of the solenoid. The injection control device also includes a transistor on the downstream side of the first and second power supply paths. A drive controller in the injection control device drives the solenoid to an open position by switching ON the transistor on the downstream side and the transistor on the upstream side of the first power supply path or the transistor on the upstream side of the second power supply path.

5 Claims, 6 Drawing Sheets

(56) References Cited

U.S. PATENT DOCUMENTS

2007/0289579 A1* 12/2007 Nagase ..... B60W 10/06
123/472
2008/0030917 A1* 2/2008 Takahashi ..... H01F 7/1811
361/152
2008/0289607 A1* 11/2008 Mayuzumi ..... F02D 41/20
123/490
2009/0024284 A1* 1/2009 Bourbiel ..... B60R 21/0132
701/45
2009/0107469 A1* 4/2009 Takahashi ..... F02D 41/20
123/490
2009/0183714 A1* 7/2009 Mayuzumi ..... H02M 1/32
123/490
2009/0243574 A1* 10/2009 Mayuzumi ..... F02D 41/20
323/282
2011/0295492 A1* 12/2011 Okuda ..... F02D 41/20
701/103
2012/0192837 A1* 8/2012 Kitamura ..... F02D 41/20
123/480
2012/0194961 A1* 8/2012 Yamada ..... F02D 41/20
361/152
2014/0020661 A1* 1/2014 Nishimura ..... F02D 41/3005
123/480
2015/0377173 A1* 12/2015 Tritsch ..... F02D 41/20
123/476
2015/0377176 A1* 12/2015 Hatanaka ..... F02M 51/061
137/554
2016/0076498 A1* 3/2016 Aono ..... F02D 41/2467
123/490

* cited by examiner

INJECTION CONTROL DEVICE

CROSS REFERENCE TO RELATED APPLICATION

The present application is based on and claims the benefit of priority of Japanese Patent Application No. 2018-081374, filed on Apr. 20, 2018, the disclosure of which is incorporated herein by reference.

TECHNICAL FIELD

The present disclosure relates to an injection control device for controlling a solenoid of an injection valve that injects fuel into an internal combustion engine.

BACKGROUND INFORMATION

Vehicles with internal combustion engines may use an injection control device to control the fuel injection to the internal combustion engine. The injection control device controls the opening and closing of one or more solenoids in an electromagnetic valve-type fuel injector to control the injection of fuel into the internal combustion engine. The valve may be driven to an open position by supplying a boosted voltage to the solenoid(s) to initially open the valve, and the valve may then be maintained in an open position by applying a lower battery voltage to the solenoid(s). The boosted voltage may be supplied by a power supply path that is separate from the power supply path used to supply the battery voltage, and a backflow prevention diode may be used on the battery supply path to prevent a backflow current from the boosted voltage from entering the battery supply path.

Problems may arise in the backflow prevention diode. As such, injection control devices are subject to improvement.

SUMMARY

The present disclosure describes an injection control device capable of reducing the heat loss caused by a backflow prevention diode in the injection control device.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
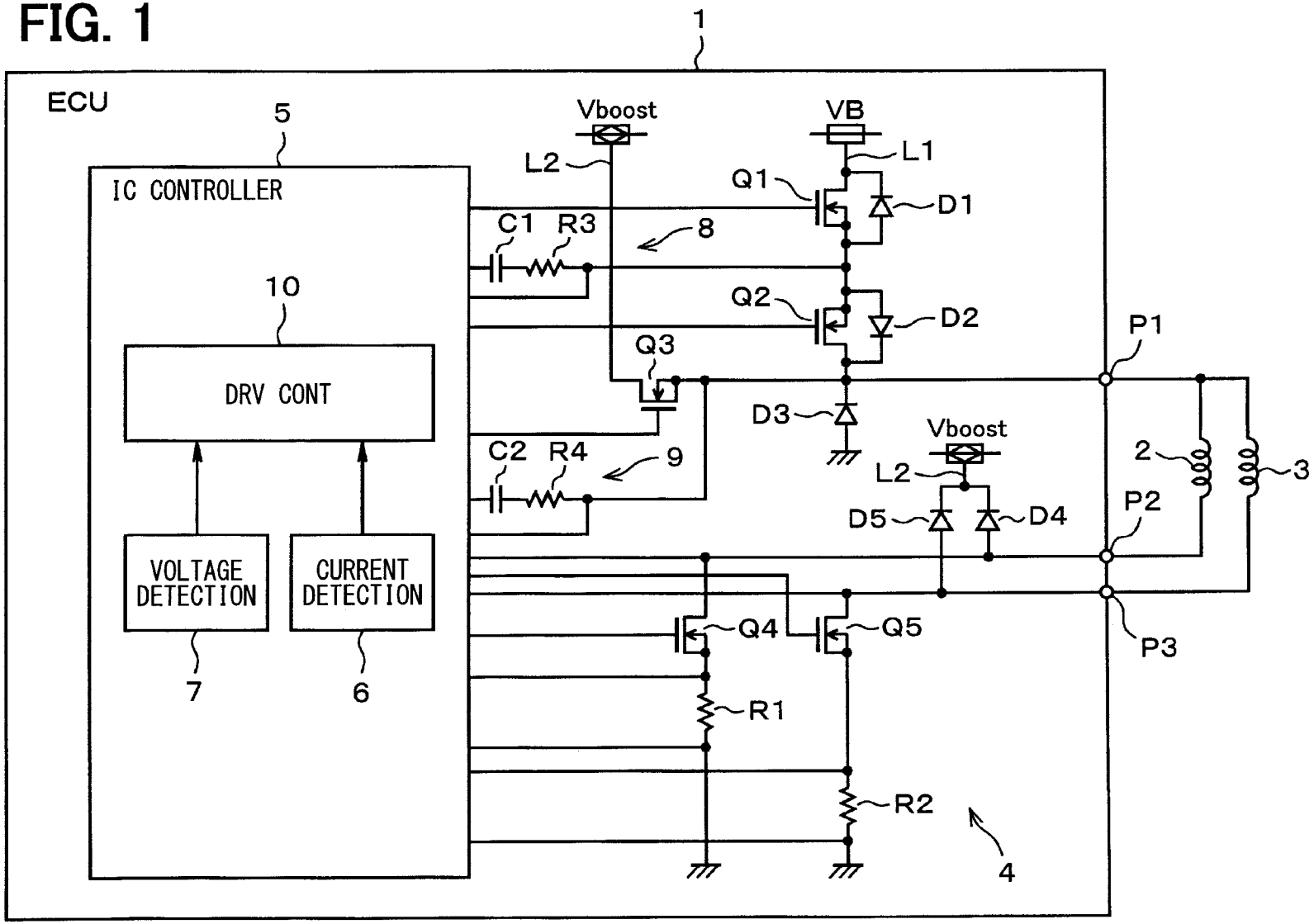
FIG. 1 illustrates a schematic configuration of an injection control device in a first embodiment of the present disclosure.

An injection control device for controlling the fuel injection of an internal combustion engine in a vehicle controls a drive (i.e., operation) of a solenoid in an injection valve to open and close the injection valve. Such an injection control device supplies a peak current to the solenoid by applying a boosted voltage to the solenoid at the start of a preset drive period, where the boosted voltage may be obtained by boosting a battery voltage of the vehicle. By using such a peak current control, the injection valve can be instantly opened (i.e., moved to an open position to begin fuel injection to the engine). After the peak current control, the injection control device supplies a constant current using the battery voltage to drive the solenoid and maintain the injection valve in an open position or open state until the drive period ends.

The injection control device may include a first upstream switch disposed on an upstream side of a first power supply path extending from a direct current (DC) power supply line to the solenoid, where the DC power supply line can supply the solenoid with the battery voltage. The injection control device may also include a second upstream switch provided on an upstream side of a second power supply path extending from a boosted power supply line to the solenoid, where the boosted power supply line may supply the solenoid with the boosted voltage. The switches may be transistors such as metal-oxide-semiconductor field-effect transistors (MOSFETs). The battery voltage may be supplied to the solenoid by turning ON the first upstream switch, and the boosted voltage may be supplied to the solenoid by turning ON the second upstream switch.

Since the boosted voltage is obtained by boosting the battery voltage of the vehicle, the boosted voltage may be, for example, about 65 V. The battery voltage of a vehicle may be, for example, about 12 V. In the above-described configuration, there is a possibility that when the boosted voltage is applied to the solenoid, a backflow of an electric current may occur and flow from the boosted power supply line to the DC power supply line and through a body diode of the first upstream switch, which may cause a heat loss to occur in addition to the backflow.

To prevent such backflow, the injection control device may use a backflow prevention diode at a position between an upstream terminal of the solenoid and the first upstream switch to block the backflow from flowing to the DC power supply line. However, the backflow prevention diode may be oriented in a forward facing direction on the first power supply path from the DC power supply line to the solenoid. As such, when a battery voltage is applied to the solenoid, the forward current from the battery voltage may flow through the forward facing backflow prevention diode causing a heat loss to occur at the backflow prevention diode. Such a heat loss may be relatively large in proportion to the forward voltage of the backflow prevention diode, and problems may arise in the injection control device as a result of such heat loss.

The embodiments of the present disclosure are described with reference to the drawings. In the following embodiments, like features and elements among the embodiments may be referred to by the same reference numerals, and a repeat description of previously described like features and elements may be omitted from the descriptions of the latter embodiments.

First Embodiment

The first embodiment of the present disclosure is described with reference to FIGS. 1 and 2.

Figure 2:
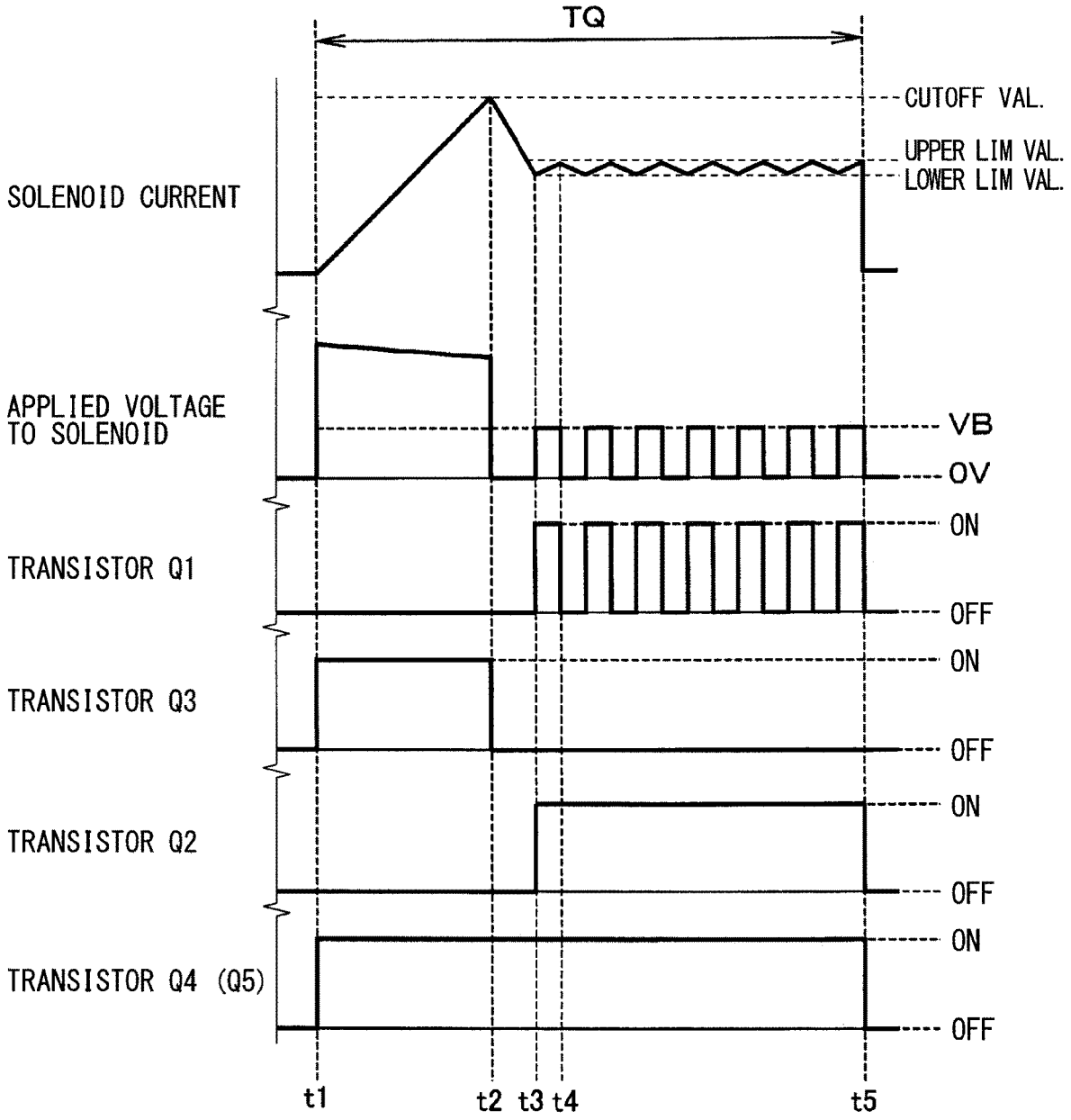
FIG. 2 is a timing chart of a solenoid current, a voltage applied to a solenoid, and a drive state of each transistor in the first embodiment.

In FIG. 1, an injection control device 1 is one of a plurality of electronic control devices or electronic control units (ECUs) installed in a vehicle. The electronic control devices may also be referred to as electronic control units (ECUs). The injection control device 1 controls the fuel injection of an internal combustion engine in a vehicle. The injection control device 1 may be referred to simply as an engine ECU 1. The engine ECU 1 integrally controls various actuators based on various sensor signals during various vehicle operations to operate the vehicle in an optimum engine state.

The injection control device 1 controls an operation of an injector that injects pressurized fuel into a cylinder of the engine. More specifically, the injection control device 1 drives or controls a drive of the injector, where "drive" may mean transmitting power or not transmitting power to control the operation of the injector. The injector is a solenoid-type electromagnetic valve with one or more solenoids 2 and 3. The injection control device 1 controls a power supply to solenoids 2 and 3 in the injector to drive the solenoids 2 and 3 (i.e., the valve) to open and closed positions. The terms electromagnetic valve or simply "valve" and solenoid may be used interchangeably. For example, driving the solenoid 2 to an open position may mean driving the valve having the solenoid 2 to an open position.

The injection control device 1 functions to control the drive (i.e., operation) of the solenoids 2 and 3. In FIG. 1, only two solenoids 2 and 3 are illustrated. However, there may be any number of solenoids based on the number of cylinders in the engine. As such, the injection control device 1 may be configured to drive a plurality of solenoids.

A battery voltage VB output from a battery in the vehicle (battery and vehicle both not shown) is supplied to the injection control device 1 via a direct current (DC) power supply line L1. The battery voltage VB is a DC voltage. The injection control device 1 has terminals P1, P2, and P3 for connecting the solenoids 2 and 3. The upstream terminals of the solenoids 2 and 3 are connected to the terminal P1. A downstream terminal of the solenoid 2 is connected to the terminal P2. A downstream terminal of the solenoid 3 is connected to the terminal P3. Upstream and downstream may be used to indicate a position of an element in the injection control device 1 relative to the power supply path of the solenoids 2 and 3, where the power supply path to the solenoids 2 and 3 may be referred to as "upstream," and the return path from the solenoids 2 and 3 may be referred to as "downstream." Similarly, an upstream terminal of the solenoid 2 may refer to the terminal on the power supply side of the solenoid 2 and the downstream terminal of the solenoid 2 may refer to the terminal on the power return side of the solenoid 2.

At the start of a preset drive period, the injection control device 1 performs a peak current control for supplying a peak current to each of the solenoids 2 and 3 to instantly open the valve. After the peak current control, the injection control device 1 then performs a constant current control to supply a constant current that is lower than the peak current to each of the solenoids 2 and 3 until the end of the drive period. The constant current supplied during the constant current control keeps the valve/solenoids 2 and 3 in an open state.

The injection control device 1 includes a drive circuit 4 and an integrated circuit (IC) controller 5. The IC controller 5 may be a system on a chip (SoC) integrated circuit-type controller 5 that includes computer and electronic components such as a processor (CPU), memory, input/output (I/O) ports such as terminals, bootstrap diodes, and like components on a single substrate in an integrated circuit package.

The drive circuit 4 includes transistors Q1, Q2, Q3, Q4, and Q5, diodes D1, D2, D3, D4, and D5, resistors R1, R2, R3, and R4, and capacitors C1 and C2. The transistors Q1-Q5 are N-channel type metal-oxide-semiconductor field-effect transistors (i.e., n-type MOSFETs). Each of the transistors Q1-Q5 has a body diode connected between its drain and source with an anode of the diode positioned on the source side and the cathode of the diode positioned on the drain side. In FIG. 1, only the diodes D1 and D2 that are the respective body diodes for the transistors Q1 and Q2 are shown, while illustrations for the body diodes of transistors Q3, Q4, and Q5 are omitted from FIG. 1.

The drain of the transistor Q1 is connected to the DC power supply line L1 that supplies the battery voltage VB, and the source of the transistor Q1 is connected to the terminal P1 via the diode D2, where the diode D2 is arranged in the forward direction (i.e., the source of the transistor Q1 is connected to the anode of the diode D2 and the cathode of the diode D2 is connected to the terminal P1). The transistor Q1 is disposed on an upstream side of a first power supply path extending from the DC power supply line L1 to the solenoids 2 and 3. As such, the transistor Q1 may be referred to as a first upstream switch.

The drain of the transistor Q3 is connected to the boost power supply line L2 that supplies a boost voltage Vboost, and the source of the transistor Q3 is connected to the terminal P1. The boost voltage Vboost may be obtained by boosting the battery voltage VB. The transistor Q3 is disposed on an upstream side of a second power supply path extending from the boost power supply line L2 to the solenoids 2 and 3. As such, the transistor Q3 may be referred to as a second upstream switch Q3.

The boost voltage Vboost is a voltage for supplying the peak current to the solenoids 2 and 3, and is generated by passing the battery voltage VB through a booster circuit (not shown). For example, the booster circuit may be configured as a boost converter (i.e., a step-up converter) that steps up the input battery voltage VB (e.g., 12 V) to generate the boost voltage Vboost as an output (e.g., 65 V).

The source of the transistor Q2 is connected to the source of the transistor Q1, and the drain of the transistor Q2 is connected to the terminal P1. The transistor Q2 is disposed in parallel with the diode D2 at a position between the upstream terminals of the solenoids 2 and 3 and the transistor Q1 on the first power supply path. The transistor Q2 may also be referred to as a short circuit switch 2.

The diode D2 is included in the injection control device 1 to prevent a backflow from flowing from the boost power supply line L2 to the DC power supply line L1 when the boost voltage Vboost is applied to the solenoids 2 and 3. As such, the diode D2 may also be referred to as a backflow prevention diode D2. The backflow prevention diode D2 is connected at a position between the upstream terminals of the solenoids 2 and 3 and the transistor Q1 on the first power supply path.

A diode D3 is disposed at a position between the terminal P1 and ground, with the cathode of the diode D3 connected to the terminal P1 and the anode of the diode D3 connected to ground. The ground or return path may refer to a reference point in the injection control device 1 having a ground potential (0 V), which is a reference potential of the injection control device circuit. The diode D3 allows a return current to flow when the current supply to the solenoids 2 and 3 is cut off. The current supply to the solenoids 2 and 3 is cut off when both of the transistors Q1 and Q3 are switched/turned OFF. The diode D3 may be referred to as a reflux diode D3.

The reflux diode D3 is connected between the upstream terminals of the solenoids 2 and 3 and ground.

The drain of the transistor Q4 is connected to the terminal P2, and the source of the transistor Q4 is connected to ground via a resistor R1. The drain of the transistor Q5 is connected to the terminal P3, and the source of the transistor Q5 is connected to ground via a resistor R2. The transistors Q4 and Q5 are disposed downstream of the solenoids 2 and 3. As such, the transistor Q4 may be referred to as a downstream switch Q4, that is, downstream (e.g., return path side) of the solenoid 2 on a return side path, and the transistors Q5 may be referred to as a downstream side switch Q5 that is downstream of the solenoid 3 on the return side path.

The IC controller 5 outputs a drive signal to the gate of each of the transistors Q1-Q5, to control the ON and OFF switching of the transistors Q1-Q5. In other words, the transistors Q1-Q5 may be independently driven (i.e., turned ON and OFF) by independent drive signals from the IC controller 5. With regard to transistors Q1-Q5, "driving," "switching," and "controlling" may all be used interchangeably to refer to operating the transistors, e.g., switching the transistors ON and OFF.

The resistors R1 and R2 may be used to respectively detect the electric current flowing through the solenoid 2 and the solenoid 3. As such, the resistors R1 and R2 may be respectively referred to as the shunt resistor R1 and the shunt resistor R2. The terminal voltages of the shunt resistors R1 and R2, that is, the inter-terminal voltage or voltage between the terminals of the resistors R1 and R2, are respectively input to the IC controller 5.

The IC controller 5 includes a current detection unit 6. The current detection unit 6 may include, for example, an amplifier circuit (not shown). The current detection unit 6 detects a solenoid current, that is, a current flowing through the solenoid 2, based on a voltage obtained by amplifying the terminal voltage of the resistor R1. The current detection unit 6 also detects a solenoid current of the solenoid 3 based on a voltage obtained by amplifying the terminal voltage of the resistor R2.

The voltages at the terminals P1, P2, and P3 are each input to the IC controller 5. The IC controller 5 includes a voltage detection unit 7. The voltage detection unit 7 may include, for example, a voltage dividing circuit (i.e., a voltage divider)(not shown). The voltage detection unit 7 detects the voltages at each of the upstream terminals of the solenoids 2 and 3 by dividing the voltage obtained at the terminal P1. The voltage detection unit 7 can also detect the voltage at the downstream terminal of the solenoid 2 by dividing the voltage at the terminal P2, and detect the voltage at the downstream terminal of the solenoid 3 by dividing the voltage at the terminal P3. The voltage detection unit 7 can detect an applied voltage applied to the solenoids 2 and 3 based on the detected voltages at the upstream terminals and the downstream terminals of the solenoids 2 and 3. Consequently, because the voltage detection unit 7 can detect the applied voltage applied to the solenoids 2 and 3, the voltage detection unit 7 may be referred to as an applied voltage detector 7.

The anode of the diode D4 is connected to the terminal P2, and the cathode of the diode D4 is connected to the boost power supply line L2. The anode of the diode D5 is connected to the terminal P3, and the cathode of the diode D5 is connected to the boost power supply line L2. In other words, the diodes D4 and D5 are connected at positions between the boost power supply line L2 and the downstream terminals of the solenoids 2 and 3, respectively. The diodes D4 and D5 direct the electric current flowing through the solenoids 2 and 3 back to the boost power supply line L2 and further to a capacitor in the booster circuit (not shown) when the transistors Q4 and Q5 are turned OFF. As such, the diodes D4 and D5 may be referred to as regeneration diodes D4 and D5.

One terminal of the capacitor C1 is connected to a bootstrap terminal of the IC controller 5 and the other terminal of the capacitor C1 is connected to the sources of each of the transistors Q1 and Q2 via the resistor R3. The sources of the transistors Q1 and Q2 are connected to the bootstrap terminal of the IC controller 5 via a bootstrap circuit 8. The capacitor C1 and the resistor R3 together with a diode in the IC controller 5 (diode not shown) make up the bootstrap circuit 8 for generating an ON drive voltage for driving the transistors Q1 and Q2 to ON. In other words, the bootstrap circuit 8 is for turning ON the transistors Q1 and Q2.

One terminal of the capacitor C2 is connected to another bootstrap terminal of the IC controller 5 and the other terminal of the capacitor C2 is connected to the source of the transistor Q3 via a resistor R4. The source of the transistor Q3 is connected to the bootstrap terminal of the IC controller 5. The capacitor C2 and the resistor R4 together with a diode in the IC controller 5 (diode not shown) make up a bootstrap circuit 9 for generating an ON drive voltage for driving the transistor Q3 to ON.

A drive controller 10 of the IC controller 5 controls an operation of the drive circuit 4. That is, the drive controller 10 in the IC controller 5 controls the ON and OFF switching of each of the transistors Q1-Q5 based on instructions from an external computer (not shown), the current detected by the current detection unit 6, and the voltage detected by the voltage detection unit 7. Specifically, the IC controller 5 selects one of the plurality of solenoids to be energized (i.e., driven) based on an instruction given from the external computer, and turns ON (i.e., performs an ON driving control of) one of the transistors Q4 and Q5 that corresponds to the selected solenoid during the preset drive period.

The IC controller 5 then drives the transistor Q3 to ON during the period when the peak current control is performed, and repeatedly drives the transistor Q1 ON and OFF during the period when the constant current control is performed. During such a drive operation, the IC controller 5 controls the drive of the transistors Q1 and Q3 so that the solenoid current has a desired current value based on the current detected by the current detection unit 6.

In such manner, the drive controller 10 turns ON the transistor Q4 and one of the transistors Q1 and Q3 to drive the solenoid 2, and turns ON the transistor Q5 and one of the transistors Q1 and Q3 to drive the solenoid 3.

Since the transistors Q1 and Q2 are an n-type MOSFETs, a drive voltage higher than the battery voltage VB is required to drive the transistors Q1 and Q2 to ON. However, the power supply voltage supplied to the IC controller 5 is, for example, 5 V, which is lower than the battery voltage VB. Consequently, the drive controller 10 in the IC controller 5 generates the ON drive voltage for the transistors Q1 and Q2 by using the above-described bootstrap circuit 8. In such manner, the drive controller 10 can generate the ON drive voltage for both of the transistors Q1 and Q2 by using the same bootstrap circuit 8.

Similarly, since the transistor Q3 is an n-type MOSFET, a voltage higher than the boost voltage Vboost is required to drive the transistor Q3 to ON. However, the power supply voltage supplied to the IC controller 5 is, for example, 5 V, which is lower than the boost voltage. Consequently, the drive controller 10 generates the ON drive voltage for the transistor Q3 by using the above-described bootstrap circuit 9.

The operation of the injection control device is described with reference to FIG. 2. While FIG. 2 and the accompanying description describes the control logic for driving the solenoid 2 to open the electromagnetic valve, a similar control logic may also be used to drive the solenoid 3.

When the preset drive period TQ begins at time t1, the drive controller 10 turns ON the transistors Q3 and Q4. As a result, the boost voltage Vboost is applied to the solenoid 2, and the solenoid current starts to increase.

The drive controller 10 also drives the transistor Q2 OFF at time t1, or alternatively, maintains the transistor Q2 in an OFF state if the transistor Q2 is not ON at time t1. As a result of turning OFF/keeping OFF the transistor Q2, the diode D2 functions in a non-short circuited state (i.e., as if there is not a short circuit between both ends of the diode D2). For example, when the diode D2 is reversed biased by a backflow, the diode D2 may act like an open circuit when the transistor Q2 is OFF. The diode D2 is disposed in the forward direction on the power supply path extending from the DC power supply line L1 to the solenoid 2. As a result of the orientation of the diode D2, backflow from the boost power supply line L2 to the DC power supply line L1 is prevented. More specifically, the diode D2 prevents a backflow current from the solenoids 2 and 3 from flowing to the DC power supply line L1 after the application of the boost voltage Vboost to the solenoids 2 and 3 is stopped and the forward current to the solenoids 2 and 3 is interrupted.

The drive controller 10 drives the transistor Q3 to OFF at time t2 when the solenoid current reaches a cutoff current value. The cutoff current value may be set based on a target value of the peak current. As a result of turning the transistor Q3 OFF (i.e., driving the transistor Q3 to OFF), the applied voltage to the solenoid 2 becomes 0 V at time t2, and the solenoid current starts to decrease. In such manner, the period from time t1 to time t2 during which the transistor Q3 is driven to ON to perform the peak current control may be referred to as the discharge period. As shown in FIG. 2, the applied voltage to the solenoid 2 gradually decreases during the discharge period due to the discharge of the capacitor in the booster circuit.

After the discharge period, the drive controller 10 performs a constant current control and repeatedly drives the transistor Q1 ON and OFF during the constant current control period (e.g., from time t3 to time t5) until the end of the drive period TQ. During the constant current control period, the solenoid 2 is supplied with a constant current to keep/maintain the electromagnetic valve open (i.e., in a valve open state). Specifically, after the discharge period has elapsed, the drive controller 10 drives the transistor Q1 to ON during the constant current control period when the solenoid current decreases to a constant current lower limit value (e.g., at time t3). As a result of switching the transistor Q1 ON, the battery voltage VB is applied to the solenoid 2 and the solenoid current again begins to increase.

The drive controller 10 drives the transistor Q1 to OFF during the constant current control period when the solenoid current increases to a constant current upper limit value (e.g., at time t4). As a result of turning off the transistor Q1, the application voltage to the solenoid 2 becomes 0 V and the solenoid current again begins to decrease. By repeating such an ON and OFF control of the transistor Q1 during the constant current control period, a constant current can be supplied to the solenoid 2.

At time t3, the drive controller 10 turns ON the transistor Q2 when the solenoid current decreases to a constant current lower limit value after the discharge period has elapsed. As a result of turning ON the transistor Q2, the diode D2 functions as if in a short circuited state (i.e., as if both ends of the diode D2 are short circuited). In the constant current period, when the battery voltage VB is applied to the solenoid 2 from the DC power supply line L1 via the transistors Q1 and Q2, both of the transistors Q1 and Q2 are turned ON, and substantially no forward current flows through the diode D2. That is, when Q2 is turned ON, very little to no forward current flows through the diode D2.

The drive controller 10 turns OFF the transistors Q1, Q2, Q3, and Q4 (i.e., Q1-Q4) at time t5 when the drive period TQ ends. The transistor Q2 turns from OFF to ON at time t3 and from ON to OFF at time t5. As such, the amount of time Ts the transistor Q2 is turned ON (i.e., the ON period Ts for transistor Q2) is equal to the constant current period Tc (e.g., from time t3 to time t5) as shown in the following equation (1).

$$Ts = Tc \qquad \text{Equation (1)}$$

The present embodiment described above can achieve and realize the following advantageous effects. In the injection control device 1 of the present embodiment, when the transistor Q1 and the transistor Q4 or Q5 are turned ON, the battery voltage VB is applied to the solenoid 2 or 3. When the transistor Q3 and the transistor Q4 or Q5 are turned ON, the boost voltage Vboost is applied to the solenoid 2 or 3. When the transistor Q2 is turned OFF, the diode D2 functions in a non-short circuited state, and when the transistor Q2 is turned ON, the diode D2 functions in a short circuited state.

When the boost voltage Vboost is applied to the solenoids 2 and 3, the transistor Q2 is turned OFF. When the transistor Q2 is turned OFF, a backflow prevention diode D2 that is disposed in the forward direction on the first power supply path extending from the DC power supply line L1 to the solenoids 2 and 3 prevents a backflow from the boost power supply line L2 from flowing to the DC power supply line L1.

When the battery voltage VB is applied to the solenoids 2 and 3, the transistor Q2 is turned ON. When the transistor Q2 is turned ON and the battery voltage VB is applied to the solenoids 2 and 3 from the DC power supply line L1 via the transistor Q2, no substantial forward current flows through the diode D2. Consequently, by using the above-described configuration for the injection control device 1, when the battery voltage VB is applied to the solenoids there is no heat loss caused by current flowing through the diode D2. In such cases, heat loss is caused by the transistor Q2, but the heat loss caused by the transistor Q2 is much smaller than the heat loss that would otherwise be caused by the diode D2, because the transistor Q2 is a MOSFET.

By using the above-described configuration of the injection control device 1, the heat loss can be advantageously reduced in comparison to the injection control devices used in related technologies. Thus, by using the injection control device 1 in the above-described configuration, it is possible to reduce the effects of heat loss compared to the injection control devices used in related technologies.

As the current supplied to the solenoids 2 and 3 becomes larger, the heat loss and effects of heat loss caused by the diode D2 become more noticeable. Consequently, in larger engines with larger engine capacities and higher performances that use a greater amount of current to drive the solenoids 2 and 3, the heat loss reduction effects exhibited by the injection control device 1 of the current embodiment can become even more beneficial, with the advantageous heat-loss-reducing effects of the current embodiment also becoming more noticeable.

The drive controller 10 is configured to independently control the transistors Q1 and Q2. That is, the drive controller 10 can individually control the transistors Q1 and Q2, where the ON/OFF control of one transistor is not dependent on the ON/OFF control of the other.

Such an individual control of two transistors Q1 and Q2 increases the degree of freedom in setting the amount of time the diode D2 functions in a short circuited state, making it possible fine tune such a time to better prevent backflow and better realize the heat loss reduction effects of the injection control device 1.

The drive controller 10 controls the ON and OFF switching of the transistors Q2 and Q3 to avoid overlapping the ON periods of the transistors Q2 and Q3. If the transistor Q2 is turned ON while the transistor Q3 is ON, a backflow from the boost power supply line L2 to the DC power supply line L1 occurs. By controlling the ON and OFF states of the transistors Q2 and Q3 as described above, it is possible to prevent such backflow.

The injection control device 1 includes the diodes D4 and D5 for regenerating an electric current flowing through the solenoids 2 and 3 back to the boost power supply line L2 when the transistors Q4 and Q5 are turned OFF. Then, the drive controller 10 drives both of the transistors Q1 and Q3 to OFF when the transistors Q4 and Q5 are turned OFF, by performing an ON and OFF control of the transistors Q1 and Q3. By turning OFF the transistors Q1 and Q3 when the transistors Q4 and Q5 are turned OFF, the injection control device 1 of the current embodiment can effectively realize and achieve current regenerating effects.

The drive controller 10 generates an ON drive voltage for turning ON the transistors Q1 and Q2 by using a single bootstrap circuit 8. By using such a configuration where the transistors Q1 and Q2 share the same bootstrap circuit 8, the number of circuit elements can be reduced.

Second Embodiment

Figure 3:
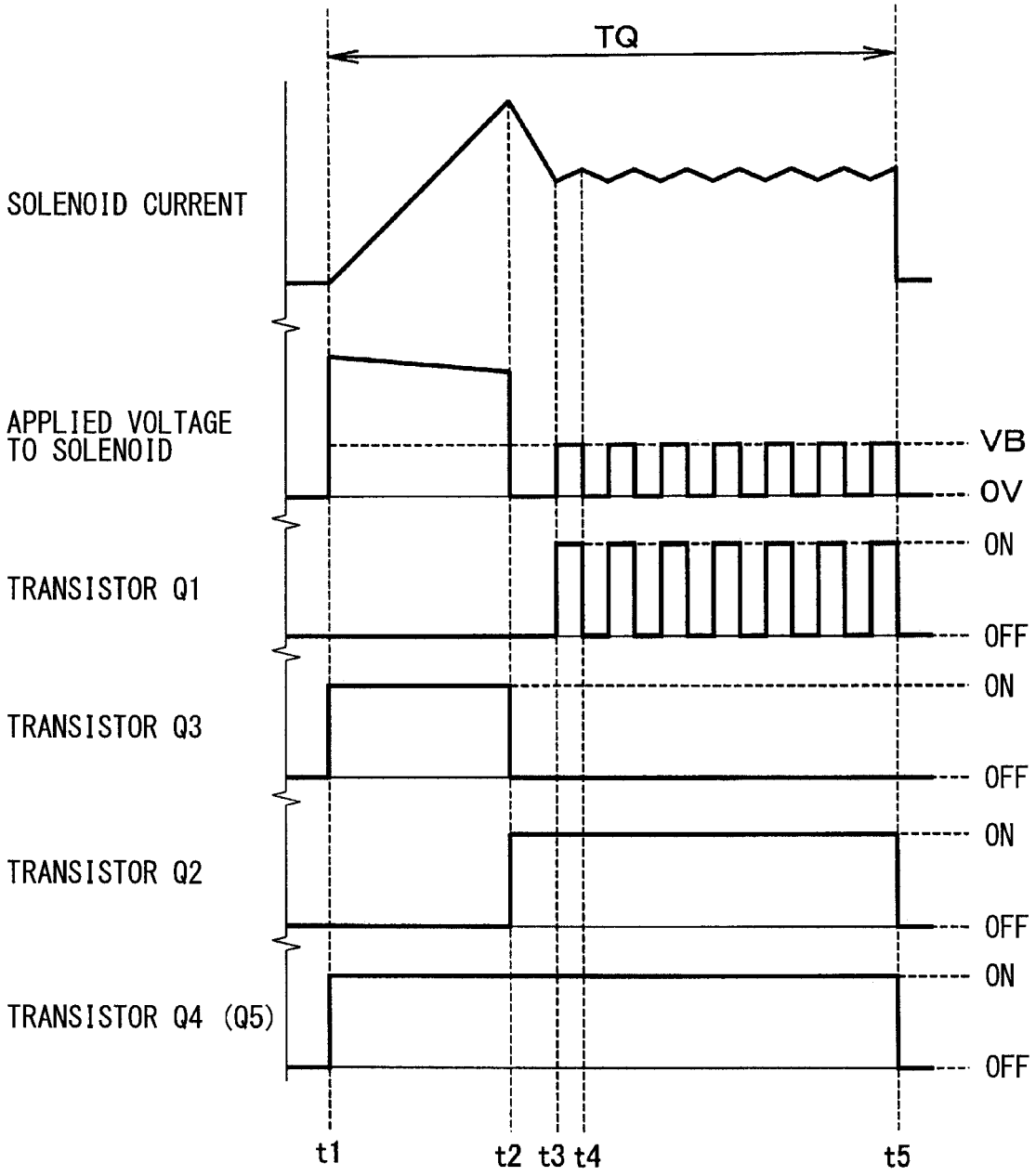
FIG. 3 is a timing chart of a solenoid current, a voltage applied to a solenoid, and a drive state of each transistor in a second embodiment of the present disclosure.

The second embodiment of the present disclosure is described with reference to FIG. 3. The description of the second embodiment focuses on the differences from the first embodiment in the control logic for driving the solenoids 2 and 3. In the second embodiment, the configuration of the injection control device 1 is the same as the configuration of the injection control device 1 in the first embodiment, as shown in FIG. 1.

In the control logic of the present embodiment, the time at which the transistor Q2 is turned ON differs from the ON time in the control logic of the first embodiment. That is, in the present embodiment, the drive controller 10 drives the transistor Q2 to ON at time t2 when the solenoid current reaches the cutoff current value.

As described above, in the present embodiment, the transistor Q2 turns from OFF to ON at time t2 and from ON to OFF at time t5. The ON period Ts during which the transistor Q2 is turned ON and the diode D2 functions in a short circuited state can be calculated from equation (2). In equation (2) the ON period Ts for the transistor Q2 is obtained by subtracting the discharge period Td from the total drive period TQ. The discharge period Td is the period where the discharge control is performed (e.g., from time t1 to time t2 in FIG. 3).

$$Ts=TQ-Td \qquad \text{Equation (2)}$$

In the present embodiment, the transistor Q2 is turned OFF when the boost voltage Vboost is applied to the solenoids 2 and 3, and turned ON before and during the time when the battery voltage VB is applied to the solenoids 2 and 3. Because the control of the transistor Q2 in the second embodiment is very similar to the control of the transistor Q2 in the first embodiment, the second embodiment can achieve and realize the advantageous effects of preventing backflow and reducing heat loss, which are substantially the same as those achieved by the first embodiment.

The control logic of the present embodiment can be modified as follows. The drive controller 10 may control the transistor Q2 to be turned OFF when the voltage detection unit 7 detects that the applied voltage to the solenoids 2 and 3 is higher than the battery voltage VB. Even by using this modified control scheme for turning OFF the transistor Q2, the amount of time that the transistor Q2 is turned ON and functions in a short circuited state during the drive period TQ is substantially the same as the ON time period Ts in equation (2).

Consequently, even by using this example control modification, effects similar to those of the above-described embodiment can be achieved. Since the transistor Q2 is controlled based on the detection value of the applied voltage to the solenoids 2 and 3 in this example control modification, the backflow may be better controlled (i.e., prevented) compared to the control logic where the transistor Q2 is controlled based on the detected value of the solenoid current.

Third Embodiment

Figure 4:
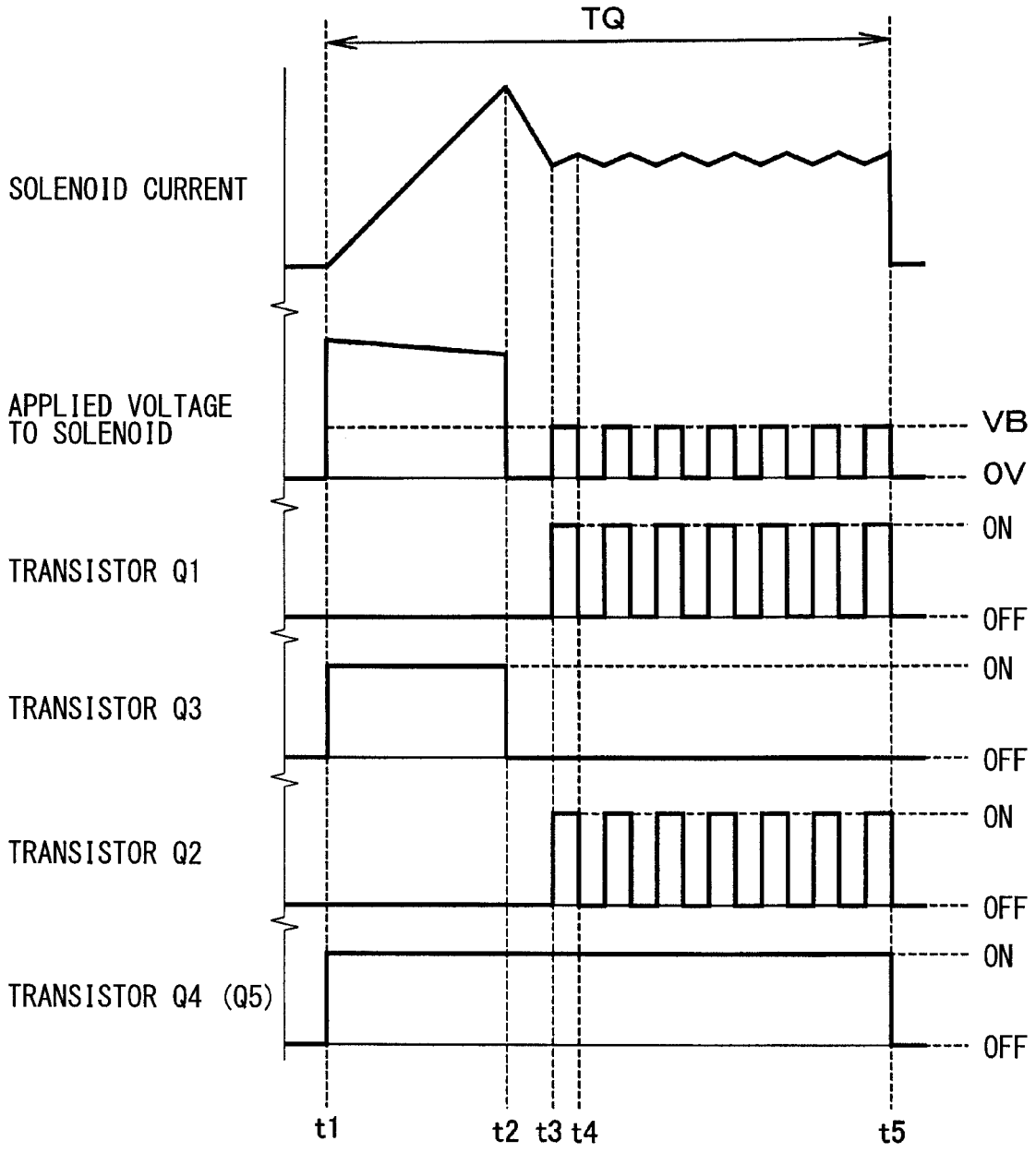
FIG. 4 is a timing chart of a solenoid current, a voltage applied to a solenoid, and a drive state of each transistor in a third embodiment of the present disclosure.

The third embodiment of the present disclosure is described with reference to FIG. 4. The description of the third embodiment focuses on the differences from the previous embodiment in the control logic for driving the solenoids 2 and 3. In the third embodiment, the configuration of the injection control device 1 is the same as the configuration of the injection control device 1 in the first embodiment, as shown in FIG. 1.

In the control logic of the present embodiment, the ON and OFF control of the transistor Q2 is different from that of the control logic of the previous embodiment. In the present embodiment, the drive controller 10 performs the same ON and OFF control for the transistor Q1 and the transistor Q2. That is, the drive controller 10 drives both the transistors Q1 and Q2 to ON during the constant current control period when the solenoid current falls to the constant current lower limit value (e.g., at time t3) after the discharge period has elapsed. The drive controller 10 turns OFF the transistors Q1 and Q2 during the constant current control period when the solenoid current reaches the constant current upper limit value (e.g., at time t4).

As described above, in the present embodiment, the transistor Q2 is turned ON when the transistor Q1 is turned ON, and turned OFF when the transistor Q1 is turned OFF. That is, the total ON time Ts for the transistor Q2 where the diode D2 functions in a short circuited state is equal to the total ON time Tq1 during which the transistor Q1 is turned ON. The total ON time Ts for the transistor Q2 is given in equation (3).

$$Ts=Tq1 \qquad \text{Equation (3)}$$

In the present embodiment, the transistor Q2 is turned OFF when the boost voltage Vboost is applied to the solenoids 2 and 3, and turned ON when the battery voltage VB is applied to the solenoids 2 and 3, similar to the control of the transistor Q2 in the first embodiment. As a result, the present embodiment can achieve and realize the advantageous effects of preventing backflow and reducing heat loss, which are substantially the same as those achieved by the first embodiment. Since the present embodiment also performs the same ON and OFF control for both of the transistors Q1 and Q2, the control logic of the injection control device 1 can be simplified.

Fourth Embodiment

Figure 5:
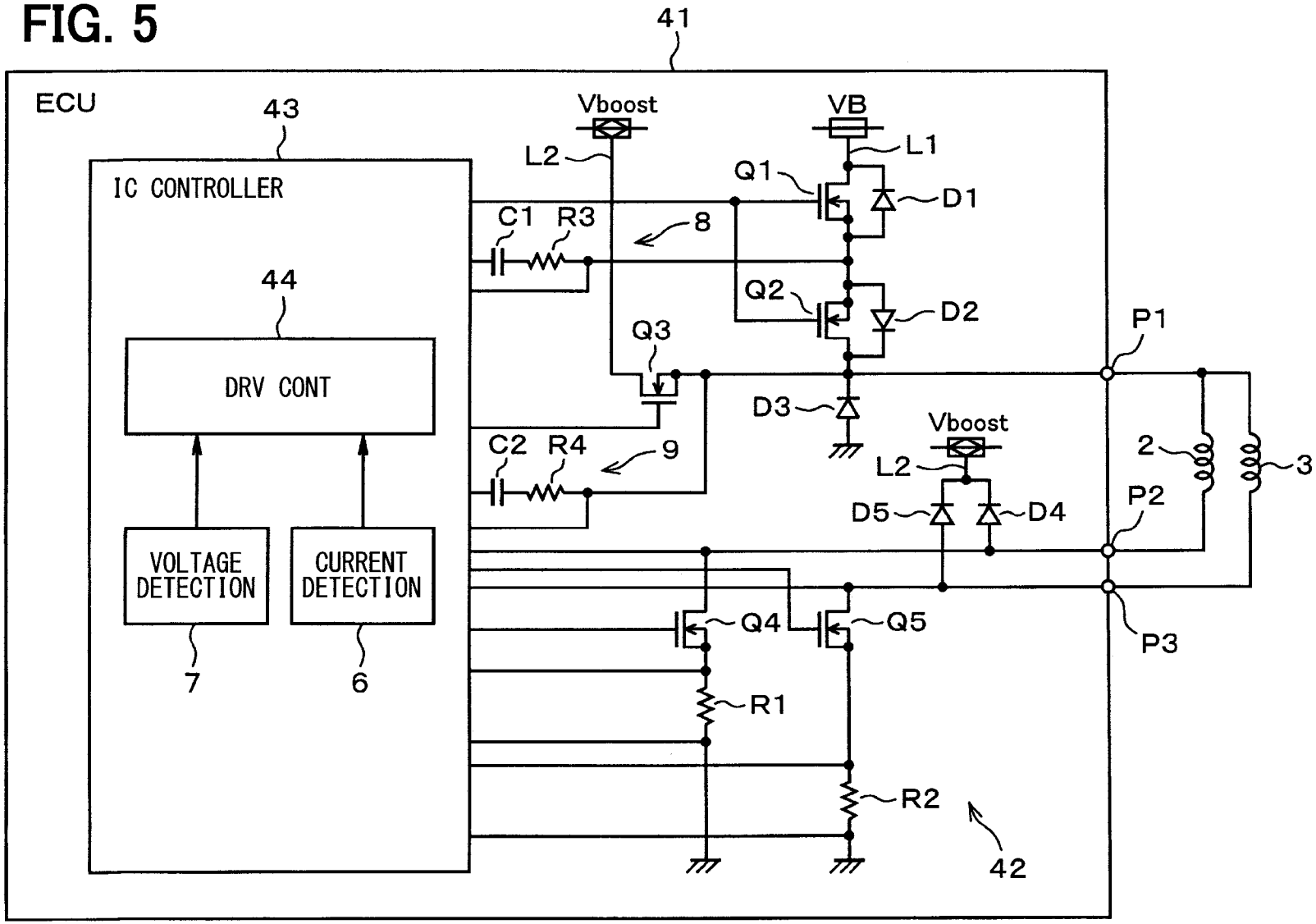
FIG. 5 illustrates a configuration of an injection control device in a fourth embodiment of the present disclosure.

The fourth embodiment of the present disclosure is described with reference to FIG. 5. An injection control device 41 of the present embodiment is different from the injection control device 1 in the first embodiment in that the present embodiment replaces the drive circuit 4 and the IC controller 5 of the first embodiment with a drive circuit 42 and an IC controller 43.

The drive circuit 42 and the IC controller 43 are different from the drive circuit 4 and the IC controller 5 in terms of driving the transistor Q2. In the present embodiment, a common drive signal is output from the IC controller 43 and applied to the gates of the transistors Q1 and Q2 to control the ON and OFF switching of the transistors Q1 and Q2. That is, in this case, a drive controller 44 of the IC controller 43 controls the ON and OFF switching of both the transistors Q1 and Q2 by using the same drive signal.

Figure 6:
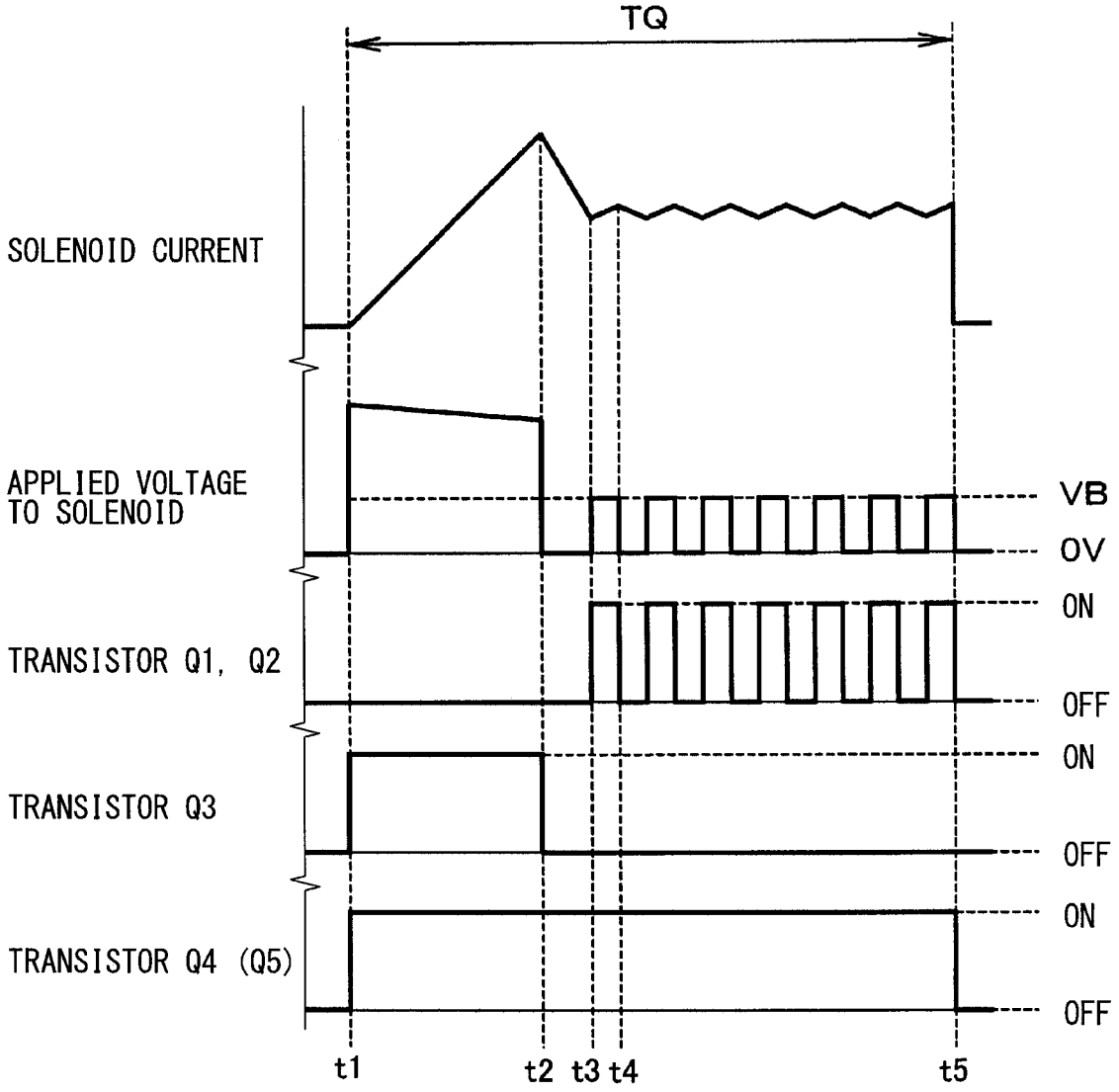
FIG. 6 is timing chart of a solenoid current, a voltage applied to a solenoid, and a drive state of each transistor in the fourth embodiment.

The control process performed by the above-described configuration is described with reference to FIG. 6. The control logic of the present embodiment is different from the control logic of the first embodiment in terms of controlling the ON and OFF switching of the transistor Q2. As described above, in the present embodiment, the drive controller 44 controls the ON and OFF switching of both the transistors Q1 and Q2 by using a common drive signal that is shared among the transistors Q1 and Q2.

After the discharge period elapses (e.g., after time t2), the drive controller 44 drives the transistor Q2 to ON during the constant current control period (e.g. from time t3 to time t5) when the solenoid current decreases to the constant current lower limit value (e.g., at time t3). The drive controller 44 drives the transistor Q2 to OFF during the constant current control period when the solenoid current reaches the constant current upper limit value (e.g., at time t4).

As described above, in the present embodiment, the transistor Q2 is turned ON when the transistor Q1 is turned ON, and turned OFF when the transistor Q1 is turned OFF, because they share the same ON/OFF drive signal. The total ON time Ts for the transistor Q2 where the transistor Q2 is turned ON and the diode D2 functions as if in a short circuited state is equal to the total ON time Tq1 for transistor Q1, as given in equation (3), just like the third embodiment.

In the present embodiment, the transistor Q2 is turned OFF when the boost voltage Vboost is applied to the solenoids 2 and 3, and turned ON when the battery voltage VB is applied to the solenoids 2 and 3, similar to the control of the transistor Q2 in the first embodiment. As a result, the present embodiment can achieve and realize the advantageous effects of preventing backflow and reducing heat loss, which are substantially the same as those achieved by the first embodiment. Since the present embodiment also performs the same ON and OFF control for both of the transistors Q1 and Q2, the control logic of the injection control device 1 can be simplified similar to the third embodiment.

OTHER EMBODIMENTS

The present disclosure is not limited to the embodiments described above and illustrated in the drawings, and can be arbitrarily modified, combined, or expanded without departing from the scope of the injection control device described in the description. The numerical values given in the above embodiments are examples only, and are not intended to be limiting.

The present disclosure is not limited to an injection control device in an engine ECU that controls the fuel injection of an engine, but can also be applied generally to an injection control device that controls the drive of a solenoid in an injection valve that injects fuel to an internal combustion engine. In other words, the above-described embodiments are not limited to use in an engine ECU.

The transistors Q1, Q2, Q3, Q4, and Q5 are not limited to n-type MOSFETs, and various types of semiconductor switching elements can also be used. The reflux diode is not limited to the diode used as the body diode of the transistor Q2, and one or more additional diodes may be used as reflux diodes.

Although the present disclosure has been described in accordance with the embodiments, it should be understood that the present disclosure is not limited to those embodiments and structures disclosed therein. The present disclosure covers various modification examples and equivalent arrangements. Furthermore, various combinations of the embodiments, where such combinations may add additional elements to the combination or remove elements from the combination, are understood to be included within the scope of the present disclosure.

What is claimed is:

1. An injection control device for controlling a solenoid used in an injection valve that injects fuel to an internal combustion engine, the injection control device comprising:

a first upstream switch disposed on an upstream side of a first power supply path that extends from a direct current (DC) power supply line to the solenoid, the DC power supply line configured to supply a DC voltage to the solenoid;

a second upstream switch disposed on an upstream side of a second power supply path that extends from a boost power supply line to the solenoid, the boost power supply line configured to supply a boosted voltage to the solenoid, the boosted voltage obtained by boosting the DC voltage;

a downstream switch disposed on a downstream side of the first and second power supply paths;

a backflow prevention diode disposed at a position between an upstream terminal of the solenoid and the first upstream switch, an anode of the diode connected to the first upstream switch;

a short circuit switch disposed at a position between the upstream terminal of the solenoid and the first upstream switch, the short circuit switch arranged in parallel with the backflow prevention diode; and a drive controller configured to control a drive of the solenoid by controlling an ON and OFF switching of the first upstream switch, the second upstream switch, the downstream switch, and the short-circuit switch, the drive controller further configured to drive the solenoid to an open position by switching ON the downstream switch and one of the first upstream switch and the second upstream switch, wherein the drive controller is configured to perform a same ON and OFF switching control for both the first upstream switch and the short circuit switch, and wherein the drive controller is further configured to control the same ON and OFF switching control of the first upstream switch and the short circuit switch by using a common drive signal between the first upstream switch and the short circuit switch.

2. The injection control device of claim 1, wherein the drive controller is further configured to control the ON and OFF switching of the short circuit switch and the second upstream switch so that the short circuit switch is not switched ON when the second upstream switch is ON.

3. The injection control device of claim 1 further comprising:

a regeneration diode disposed at a position between the boost power supply line and a downstream terminal of the solenoid, the regeneration diode having an anode connected the downstream terminal of the solenoid, wherein the drive controller is further configured to switch OFF both the first upstream switch and the second upstream switch when the downstream switch is OFF.

4. An injection control device for controlling a solenoid used in an injection valve that injects fuel to an internal combustion engine, the injection control device comprising:

a first upstream switch disposed on an upstream side of a first power supply path that extends from a direct current (DC) power supply line to the solenoid, the DC power supply line configured to supply a DC voltage to the solenoid;

a second upstream switch disposed on an upstream side of a second power supply path that extends from a boost power supply line to the solenoid, the boost power supply line configured to supply a boosted voltage to the solenoid, the boosted voltage obtained by boosting the DC voltage;

a downstream switch disposed on a downstream side of the first and second power supply paths;

a backflow prevention diode disposed at a position between an upstream terminal of the solenoid and the first upstream switch, an anode of the diode connected to the first upstream switch;

a short circuit switch disposed at a position between the upstream terminal of the solenoid and the first upstream switch, the short circuit switch arranged in parallel with the backflow prevention diode;

a drive controller configured to control a drive of the solenoid by controlling an ON and OFF switching of the first upstream switch, the second upstream switch, the downstream switch, and the short-circuit switch, the drive controller further configured to drive the solenoid to an open position by switching ON the downstream switch and one of the first upstream switch and the second upstream switch; and an applied voltage detector configured to detect an applied voltage to the solenoid, wherein the drive controller is further configured to switch the short circuit switch to OFF when the applied voltage detected by the applied voltage detector is greater than the DC voltage.

5. An injection control device for controlling a solenoid used in an injection valve that injects fuel to an internal combustion engine, the injection control device comprising:

a first upstream switch disposed on an upstream side of a first power supply path that extends from a direct current (DC) power supply line to the solenoid, the DC power supply line configured to supply a DC voltage to the solenoid;

a second upstream switch disposed on an upstream side of a second power supply path that extends from a boost power supply line to the solenoid, the boost power supply line configured to supply a boosted voltage to the solenoid, the boosted voltage obtained by boosting the DC voltage;

a downstream switch disposed on a downstream side of the first and second power supply paths;

a backflow prevention diode disposed at a position between an upstream terminal of the solenoid and the first upstream switch, an anode of the diode connected to the first upstream switch;

a short circuit switch disposed at a position between the upstream terminal of the solenoid and the first upstream switch, the short circuit switch arranged in parallel with the backflow prevention diode; and a drive controller configured to control a drive of the solenoid by controlling an ON and OFF switching of the first upstream switch, the second upstream switch, the downstream switch, and the short-circuit switch, the drive controller further configured to drive the solenoid to an open position by switching ON the downstream switch and one of the first upstream switch and the second upstream switch, wherein the first upstream switch and the short circuit switch are both n-type MOSFETs, and wherein the drive controller is further configured to generate an ON drive voltage for turning ON the first upstream switch and an ON drive voltage for turning ON the short circuit switch by using a common bootstrap circuit shared by the first upstream switch and the short circuit switch.

* * * * *